US005353858A

United States Patent [19]

Hartmann

[11] Patent Number: 5,353,858

[45] Date of Patent: Oct. 11, 1994

[54] CLOSING ELEMENT FOR ROOMS

[75] Inventor: Jörg Hartmann, Moers, Fed. Rep. of Germany

[73] Assignee: Frank Lange, Siegen, Fed. Rep. of Germany

[21] Appl. No.: 919,790

[22] Filed: Jul. 27, 1992

[30] Foreign Application Priority Data

Jul. 31, 1991 [DE] Fed. Rep. of Germany ..... 4125269

[51] Int. Cl.[5] ..... A47G 5/02

[52] U.S. Cl. ..... 160/264; 160/10; 428/60; 428/906

[58] Field of Search ..... 160/10, 264, 238, 310; 428/60, 906

[56] References Cited

U.S. PATENT DOCUMENTS

| | | | |
|---|---|---|---|
| 3,161,258 | 12/1964 | Chapman | 160/264 X |
| 3,583,465 | 6/1971 | Youngs | 160/264 |
| 3,696,373 | 10/1972 | Dunn et al. | 160/10 X |
| 5,107,917 | 4/1992 | Larsson | 160/264 X |
| 5,208,087 | 5/1993 | Stieberg | 428/60 |

FOREIGN PATENT DOCUMENTS

| | | | |
|---|---|---|---|
| 0210364A2 | 5/1986 | European Pat. Off. . | |
| 2841966 | 4/1979 | Fed. Rep. of Germany | 160/238 |
| 2833579 | 7/1979 | Fed. Rep. of Germany | 160/238 |
| 3531633C2 | 9/1990 | Fed. Rep. of Germany . | |
| 3943383 | 7/1991 | Fed. Rep. of Germany | 160/238 |
| 7432191 | 1/1975 | United Kingdom . | |

*Primary Examiner*—Blair M. Johnson

*Attorney, Agent, or Firm*—Cohen, Pontani, Lieberman, Pavane

[57] ABSTRACT

A closing element for rooms, such as buildings, containers, superstructures of vehicles or the like, which can be rolled up and covers a two-dimensional area. The closing element is of a flexible material which can be rolled up and is reinforced transversely of its rolling direction by bending-resistant reinforcement layers which increase the transverse stiffness and which are embedded on both sides of a core zone within the closing element. At least the core zone of the closing element is of a shifting-resistant material of middle-soft formulation of approximately 70–85 shore A, and/or textile and/or metal flakes or fibers are mixed into the material of the core zone.

23 Claims, 3 Drawing Sheets

CLOSING ELEMENT FOR ROOMS

BACKGROUND OF THE INVENTION

1. Field of the Invention

The present invention relates to a closing element for rooms, such as, buildings, containers, superstructures of vehicles or the like. The closing element covers a two-dimensional area and can be rolled up. The closing element is of a flexible material which can be rolled up and which is reinforced transversely of its rolling direction by means of bending-resistant reinforcement layers which increase the transverse stiffness and which are embedded on both sides of a core zone within the closing element.

2. Description of the Related Art

Rolling doors whose hanging portions are composed of individual lamella-type sections of metal or plastics material which are connected to each other by means of hinges transversely of the rolling direction have been known for decades. Rolling doors of this type can be moved only slowly because they have mechanical hinges and produce unwanted, sometimes shrieking noises when they are moved. These rolling doors are susceptible to damage during everyday operation, particularly due to impacts from vehicles, such as, stacker trucks. The repair of the damage is complicated because deformed pans, such as, steel lamellas, are difficult to replace. Also, such rolling doors do not provide protection against cold temperatures and sound.

Also known in the art are so-called high-speed doors which are composed of a relatively thin flexible hanging material made from webs of textile or plastics material. These doors can be moved several times faster. In addition, they are tight against wind. However, the major disadvantage of these high-speed doors is the necessary complicated mechanism because the highly flexible materials used in the doors are not capable of transmitting thrust or pushing forces. The use of these doors is limited because they do not provide sufficient protection against break-ins and because of their manufacturing costs. As a rule, these doors can only be used within plants, and the use of the doors is essentially limited to protective curtains or auxiliary doors.

The proposal according to EP-A-0210364 was intended to eliminate the disadvantages of the above-described doors. The rolling door construction according to this reference combines a highly flexible curtain with metal or steel sections. However, this rolling door still has the significant disadvantages described above. Moreover, when hard and soft materials are connected, stresses within the hanging portion cannot be excluded, so that a satisfactory, problem-free operation duration cannot be expected, especially since too many parts are joined together and connected and must be wound up with portions rubbing against each other. This inevitably results in high manufacturing and maintenance costs.

DE-Gbm 74 32 191 discloses an improvement of a rolling door for steam chambers. This rolling door is composed of a rubber plate which is reinforced with only two fabric inserts which extend parallel to each other and are spaced apart from each other by an elastic core which can be rolled up in rolling direction. The principle of the beam used in this case did not meet expectations in spite of the thickness of the plate of up to 20 mm. because the apparent danger of decay due to the steam did not permit use of metal fabric in the outer areas of the hanging portion.

Therefore, because of the unwanted formation of waves in the hanging portion due to the absorption of water by the fabrics and the uncontrollable shrinkage behavior thereof, the elastic rubber core is stiffened between the fabrics by means of spaced-apart steel strips having a thickness of 1–2 mm. which are vulcanized into the rubber core and extend centrally transversely of the travel direction of the rolling door. The purpose of the steel strips is to prevent distortion and shrinkage of the fabric. On the other hand, the steel strips also prevent the elastic spacer core between the fabrics from being deformed transversely of the rolling axis when the steam pressure acts on the surface area of the hanging portion and from being displaced relative to the fabric layers which are arranged on both sides and act as an upper portion and a lower portion.

The rolling door according to DE-C-3531633 also utilizes the carrier principle with a soft core with reinforcements arranged on both sides for another special task, namely, as a rolling hanging portion or door of sandblast cabins. Sandblast cabins are frequently formed by adjustable rolling brackets, i.e., rolling adjustable walls. Stationary cabins with entrances require only doors which, although they have a relatively small width, can still be considered doors.

DE-C-3531633 mentions the rolling bracket with a shaft mounted thereon in the description of the drawing and also mentions "the free hanging in the manner of a curtain." Free hanging of the door and a still sufficient resistance to sandblast pressure or air pressure requires that the door has a substantial own weight and that the curtain or closing element is resistant to operation.

The resistance to abrasion and the required service life in view of the aggressive materials acting on door are obtained in practice by means of so-called wearing mixtures which have a high capability of expansion of approximately 450–600% and a low resistance to expansion.

The own weight of the curtain results from mass and is obtained by the strong outer skin for deflecting the sand blast material as well as a spacer core with two steel cord fabric layers and a fabric in the middle, wherein the spacer core is thick for this type of application and, therefore, has good damping properties. The use of fabrics in the core zones can only be considered an advantage because they neutralize the high capability of expansion of such soft mixtures and the low resistance to expansion of the particularly soft rubber material under the high weights occurring during rolling. Such an element when used as a curtain tensions itself and, as a rule, is only used within plants in order to prevent escape of sand into the surrounding area. Such closing elements cannot be used, for example, as industrial doors because they do not meet the technical requirements and are not competitive relative to other door systems as far as costs are concerned.

Because of the unfavorable expansion and upsetting behavior of the soft material in the core zone, the upper portion and lower portion are displaced relative to each other and break out toward one side. They can also not handle any pushing forces because they are too soft in rolling direction. Since a freely hanging curtain requires weight, the hanging door does not operate properly when the weight is too small. In addition, the operation of a freely hanging curtain cannot be transferred to an industrial door. A wind-tight door of a building which is guided at the edges and in the outer regions thereof must be capable of absorbing the same wind pressure as is required for a building wall. A closing member for a sand blast cabin according to DE-C-3531633 would be pressed out of the guide means at the edges already at an average wind load acting over the full width of approximately 2 meters. This is because the closing member does not have sufficient transverse stiffening means.

Finally, an economically acceptable manufacture was in the past not possible because of the requirement that conventional giant presses costing millions had to be used. At present, the width of such presses is limited to approximately 3 meters. On the other hand, the use of such presses for manufacturing closing elements of the type discussed above is not possible because of the high costs of use and amortization.

SUMMARY OF THE INVENTION

Starting from the above-described problems and disadvantages of known closing elements, it is the object of the present invention to provide a rolling closing element for rooms, particularly industrial buildings, which has the following properties:

1. A balanced cost/benefit ratio of the material required for a sufficient stiffening of the closing element, particularly of a closing element for large doors, against a concentrated load and against a load acting over a surface area transversely of the rolling direction.
2. Possibility of manufacturing the closing element on conventional presses and/or known plants without use of giant presses.
3. Production in large quantities utilizing a universal modular or construction principle; particularly in the outer region, the closing element should be of variable construction; the closing element should have high-speed travel properties and the travel should be with little noise; the closing element should be capable of insulation against sound and temperature; the closing element should transmit without problems pushing forces in closing direction; finally, the closing element is to provide substantial protection against break-ins and fire.

In accordance with the present invention, at least the core zone is of a displacement-resistant or shifting-resistant material of middle-soft formulation of approximately 70–85 Shore A and/or textile and/or metal flakes or fibers are mixed into the material of the core zone.

The configuration of the closing element according to the present invention makes possible even without additional fabric in the core zone a substantially improved high transverse stiffness while significantly reducing the thickness, so that the quantity of material required is correspondingly reduced. The capability of the closing element according to the present invention of transmitting pushing forces is of particular significance. Since, depending on the material used, weather changes or temperature changes lead to expansion or shrinkage of the closing element, the closing element may easily be jammed in its guide means. Wind loads acting on the closing element may also impair the mobility of the closing element in its guide means. In these cases, it is absolutely necessary that the closing element can transmit pushing forces, so that the usually small jamming forces can be overcome.

In addition to the strength against pushing forces exerted in the above-described manner, the closing element according to the present invention, even though the thickness in the core zone is reduced, provides an excellent capability of rolling and a long surface life of the closing element. The closing element can be rolled even in the high-speed range and when the rolling diameters are small, i.e., when the space available for mounting the closing element is small.

The improvements provided by the closing element according to the present invention as compared to those of the prior art eliminate serious problems of known rolling closing elements and make it possible that the closing element can be used in almost any situation for closing openings of buildings or of vehicles toward the outside. Even extremely large wall and roof openings can be closed easily and tightly and in an economically acceptable manner.

The harder core area and the outer reinforcement layers statically act in the manner of a girder, wherein the reinforcement layers are the upper and lower flanges of this girder and the relatively harder core area forms the web. It is of particular significance with respect to the transverse strength of the closing element that the core zone is resistant to displacement and expansion, because in addition to pulling forces the element is also capable of absorbing pushing forces.

In accordance with another feature of the present invention, the outer region of the closing element formed on both sides of the core zone is of a soft, abrasion-resistant and noise-damping material, so that the damping property and the wear resistance of the closing element is increased without negatively influencing the strength in transverse direction. The harder core transmits the pushing forces exerted by the winding roller better than a softer core, so that not only exclusively the own weight of the element must be used for closing the closing element. As a result, the closing element according to tin, invention can also be used for closing room openings which do not extend vertically.

As a rule, the capability of expansion and upsetting is reduced when the material of the core zone is harder. Nevertheless, the material remains sufficiently flexible. While the flexible spacer core follows the winding roller, the embedded transverse reinforcements are taken along without problems in winding direction and the closing element is rolled up with little noise due to the softer, but abrasion-resistant outer portion.

The reinforcements embedded on both sides of the core zone are stiff transversely of the winding direction and only resiliently yield when high loads are applied. The low upsetting and expansion capability of the core zone forming the spacer member reduces the relative displacement capability of the reinforcements which act as expansion and upsetting ribs in accordance with the beam principle. This configuration according to the present invention provides within the hanging portion the desired robust and bending-resistant effect of a restoration after deformation, even in cases of applications of high impact forces. A door constructed in accordance with these features is highly resistant against storm, wind, and impacts, for example, due to stacker trucks or similar vehicles.

In accordance with a particularly advantageous feature of the present invention, the closing element includes segmental sheets which are joined together transversely of the winding direction or in winding direction and which have at the longitudinal sides thereof flanges for connecting adjacent segments. This configuration of the closing element not only makes possible a particularly advantageous manufacture of the component, but it is additionally possible to exchange damages segments of the closing element.

In accordance with another proposed feature of the invention, the sheets are connected at fitting locations by means of gluing, welding, or vulcanizing, so that in case of necessary repair the damaged segment can be cut out and replaced by a new segment.

As mentioned above, it has been proposed to reinforce the core zone by admixing flakes or fibers to the material. In the same manner, in accordance with another feature of the invention, it is also possible to manufacture the core zone of the closing element of a material which is different than the remaining material of the closing element. In this regard, particularly PVC is to be mentioned, which is particularly suitable for the core zone.

Since the static requirements of the closing element constructed in accordance with the beam principle change depending on the distance of oppositely located reinforcement layers, the transverse stiffness of the closing element is increased by increasing over portions thereof the distance between the reinforcement layers arranged opposite each other on both sides of the core zone.

In accordance with a further development of the invention, the thickness of the closing element transversely of the winding direction is increased and reduced in spaced-apart portions, and the distance between the reinforcement layers is increased over portions thereof, a higher transverse stiffness of the closing element can be achieved, on the one hand, however, the winding capacity of the closing element can be improved by reducing the thickness in certain areas, on the other hand.

In addition, in order to further increase the transverse stiffness of the closing element, the distance between the reinforcement layers and the number of reinforcement layers located next to each other and one above the other may be different over certain portions.

Another advantageous improvement can be achieved if, in accordance with another feature of the invention, the thickness of the core zone is increased in direction toward one or both outer zones of the closing element. As a result of this feature, and by providing additional reinforcement layers in the region of the increased thickness, in accordance with another feature of the invention, the closing element can be reinforced without having to use an excessive amount of material relative to the overall surface area, wherein, in this case, simultaneously the distance to oppositely located reinforcements is increased.

In accordance with another advantageous proposal of the present invention, the closing element has slit protection inserts arranged at least over a portion of its extension. These slit protection inserts extend transversely, obliquely, or diagonally relative to the reinforcement layers and reinforce the closing element in closing direction and simultaneously represent a simple but effective protection against unlawful entering into the closed room.

A particularly advantageous feature provides that the slit protection inserts are electrically conductive and are connected to control devices, drive devices, and/or alarm devices. Accordingly, the slit protection inserts provide mechanical strength and simultaneously facilitate an electric or electronic operation of an alarm device.

The closing element may preferably be composed in the known manner over at least portions thereof of light-permeable and/or transparent material.

It is also advantageous if, in accordance with another proposal of the invention, the closing element is made of flame-retardant or self-extinguishing material.

A favorable running property of the closing element during opening and closing and a good wear resistance can be obtained if, in accordance with a proposal of the invention, the closing element is at least over edge portions extending parallel to the winding direction provided with a slidable wear-resistant layer.

This slidably wear-resistant layer may be improved by mounting sliding or clamping pieces on the edge portions.

In accordance with a particularly important proposal of the invention, the closing element is in its position of rest, secured by means of a clamping arrangement provided at the edge portions. This provides transverse stiffness, especially at high wind forces, and also increases the safety with respect to break-ins.

When especially high loads act on the closing element, it may be provided that endangered areas of the closing element are supported by additional stiffening members which are placed on the closing element. These stiffening members may be provided during the manufacture of the closing element or may be mounted subsequently.

In addition, in accordance with another advantageous feature of the invention, segment sheets are provided which extend transversely of the winding direction and are provided with unilaterally thickened core zones, wherein the thickened areas of abutting sheets are at least over portions alternatingly directed inwardly and outwardly. As a result, it is possible to reduce the costs of the manufacture of the closing element because segment sheets are used which are provided only on one side with a bending resistant reinforcement, while the sheets are mounted so as to be alternatingly bending resistant toward both sides.

Finally, another of the many advantages provided by the invention is the fact that the closing element can also be used as a sliding element with horizontal and/or inclined closing direction. The thickness of the closing element according to the present invention may vary. Preferably, the thickness is 5 mm to 15 mm, not including reinforcement ribs. Of course, special constructions with different dimensions are possible for all conceivable types of application.

An important field of application of the closing element according to the present invention is the construction of large doors, for example, for industrial buildings having large span widths. Such buildings with crane runways frequently have widths of 25 meters and more. For example, if the crane runway extends beyond the length of the building, the crane runway opening must be closed by separate closing elements. The closing element of the present invention can easily meet this object. A rolling door with the closing element of the invention can be opened and closed very quickly within a few seconds, produces little noise and can also be manufactured in large widths.

The closing element according to the invention can also be used outdoors as a rolling wall. Because the closing element is robust, it can replace entire outer wall sections. This is true with respect to fixed buildings as well as for superstructures of vehicles. In addition, entire roof portions can be replaced and quickly moved by the closing element according to the present invention. Thus, in production facilities in which it is necessary to quickly aerate portions of buildings, it is now possible to provide large openings of the building within a very short time. As a result, complicated suction and ventilating arrangements become unnecessary.

As already mentioned, the closing element of the present invention can also advantageously be used on vehicles. The closing element replaces known superstructures which can be rolled up. Such constructions, similar to roll-up blinds for windows, are very complicated, expensive, and susceptible to trouble. Possible uses of the closing element of the invention are in truck superstructures, in trailers, and railroad cars. The flexibility of the closing element of the present invention ranges between a typical truck tarpaulin and a rigid superstructure wall.

The closing element of the invention provides excellent protection because it is completely air-tight and water-tight. The surface of the closing element can be used as an advertisement area or the color of the element can be adapted as required and to the environment. The mechanical rolling system for the closing element can be constructed very simple and robust. If necessary, portions of the closing element may be constructed as predetermined breaking points which break in case of extreme loads in the area of replaceable components.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DESCRIPTION OF THE PREFERRED EMBODIMENTS

The figures of the drawings show details of closing elements according to the present invention as they are produced in a variety of configurations as rolling doors or wall and ceiling elements. Rolling walls and rolling ceilings differ only insignificantly from rolling doors, so that the drawings predominately show closing elements in the form of rolling doors.

Figure 1:
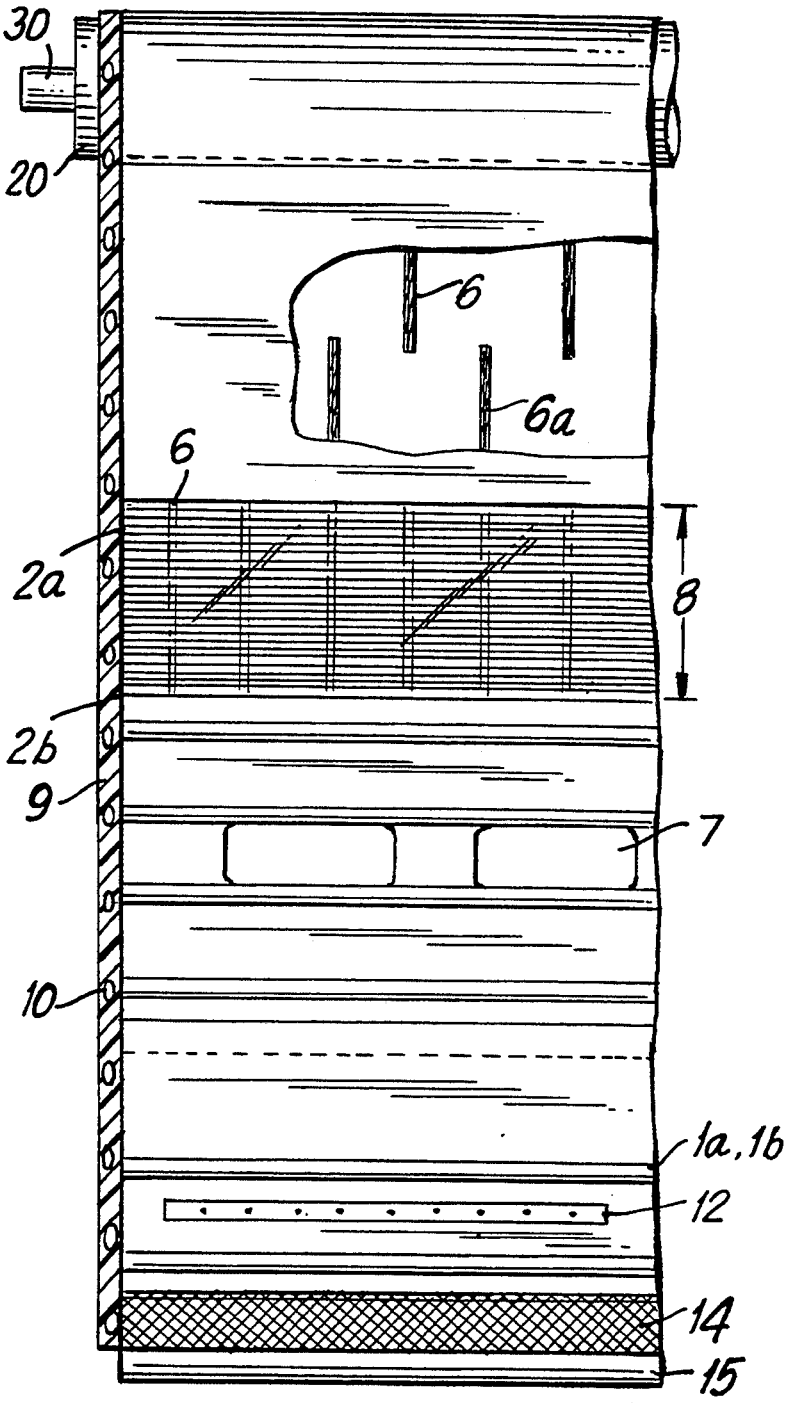
FIG. 1 is a front elevational view of a closing element according to the present invention.

FIG. 1 of the drawing is a partial elevational view of a closing element constructed as a door which operates in vertical direction and can be opened and closed by means of a winding drum 20. The hanging portion of the door usually does not have hinges or mechanical joints, however, the invention does not exclude individual joint or hinge connections between individual segment sheets.

The winding drum 20 is driven in the known manner by a motor through the shaft 30. Window-like openings 7 and transparent segment areas 8 render the closing element permeable to light and make it possible to look through the closing element. Reinforcement layers 2*a*, 2*b* arranged transversely of the closing direction of the door are visible in the transparent segment area 8. The lower portion of the closing element has rib-like increased thickness portions 1*a*, 1*b* which provide in the endangered area an increased transverse stiffening of the closing element. The closing element has an edge 9 which is coated on both sides with a particularly abrasion-resistant plastic material, such as polyurethane, so that guide rails for the edge do not produce damage due to sliding of the edge in the guide rails.

An end piece 14 in which a known stop device 15 is arranged for safety reasons is arranged above the floor. The edge 9 has sliding pieces 10, so that it is ensured that the door stays within its tracks during movement.

An area of the upper portion of the closing element is shown broken away, so that steel cord strands 6, 6*a* which serve as slit protection are visible. The steel cord strands are arranged in the flexible hanging portion of the closing element in a staggered configuration, so that local hardening during the rolling-up process is prevented.

The strands 6, 6*a* simultaneously serve as means for beating tensile loads within the closing element, in order to transmit and distribute the forces which occur when the winding shaft is rotated.

Figure 2:
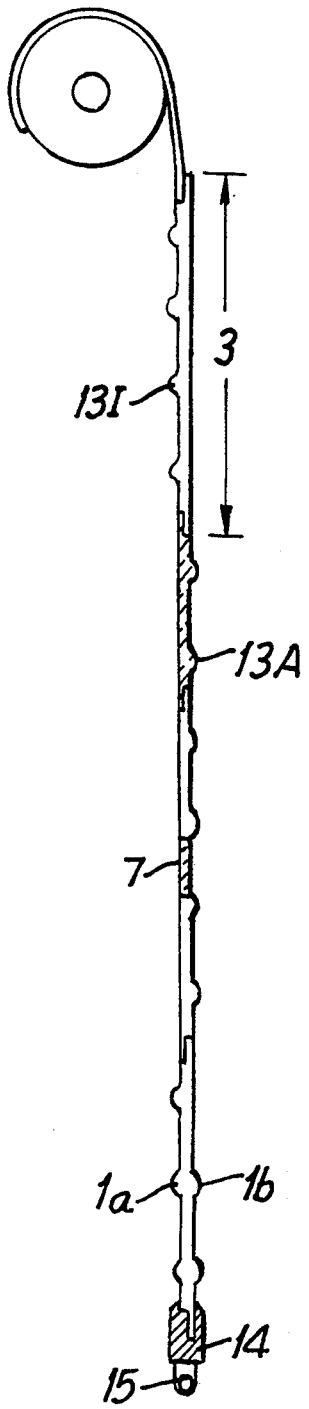
FIG. 2 is a side view of the closing element of FIG. 1.
Figure 3:
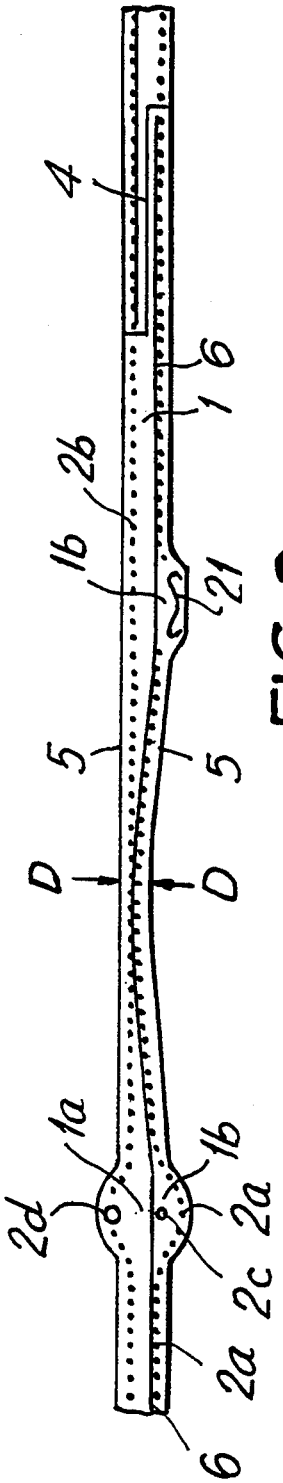
FIG. 3 is a longitudinal sectional view of a portion of a closing element with segment sheets connected transversely of the rolling direction.

FIGS. 2 and 3 of the drawing are side views of the hanging portion of the door.

FIG. 2 shows that the closing element is composed of segment sheets 3 which are joined together by overlapping and gluing or vulcanizing the sheets in winding direction. The segment sheets 3 have a width of approximately 500–1,000 mm. However, the width of the segment sheets 3 may also be greater or smaller. The uppermost segment sheet 3 is shown with a thickened core zone 13I which faces toward the inside of the building.

The next segment sheet 8 connected to segment sheet 3 is of transparent material and includes thickened portions 13A of the core zone, wherein the thickened portions are directed toward the outside. The alternating arrangement of the resulting ribs in different directions provide different reinforcement and stiffening effects as desired over different portions.

FIG. 3 is a partial sectional view of the closing element showing details of additional embodiments of the invention. At least one reinforcement layer 2*a*, 2*b* is arranged on both sides of the core zone 1, in outer portions of the closing element wherein the core zone is constructed non-expandable to the extent possible or of a hard material, while still being sufficiently permanently flexible for rolling up the closing element. A unilateral thickened portion of the core zone 1*b* is provided with a strip-like transverse reinforcement of spring steel, so that the transverse stiffness of the closing element is further increased. When pressure acting on the closing element is removed, the spring steel strip 21 automatically returns to the original position, together with the oppositely arranged reinforcement layer.

The core zone has on both sides increased thickness portions as indicated by reference numerals 1*a* and 1*b*. The increased thickness portions which have, for example, steel or textile ropes 2*c* and 2*d* of different thicknesses, are reinforcement layers. The type and dimensioning of the reinforcements can be adapted to individual requirements as desired.

FIG. 3 further shows that the closing element may include reduced thickness portions D—D of the core zone which make the closing element very thin and improve the bending behavior when the closing element is rolled up. At the reduced thickness portion, the reinforcement layers 2*a* and 2*b* are located closely together. It is also within the scope of the invention, for example, in case of low load applications, to omit the reinforcement layers 2*a* and 2*b* in certain areas. On the other hand, the spacing between the reinforcements may be smaller or several layers of reinforcements may be embedded in the closing element one above the other.

FIG. 3 additionally shows the connecting point 4 of two flexible segment sheets 3, 8. Each segment sheet 3, 8 has at its long side a flange F which matches exactly the flange F of the next segment sheet, as indicated by reference numeral 4. The flanges may be glued, welded, or vulcanized together or some individual mechanical connections may be provided.

The segment sheets 3, 8 can be joined together transversely as well as longitudinally in rolling direction in order to obtain a single-piece closing element.

Figure 4:
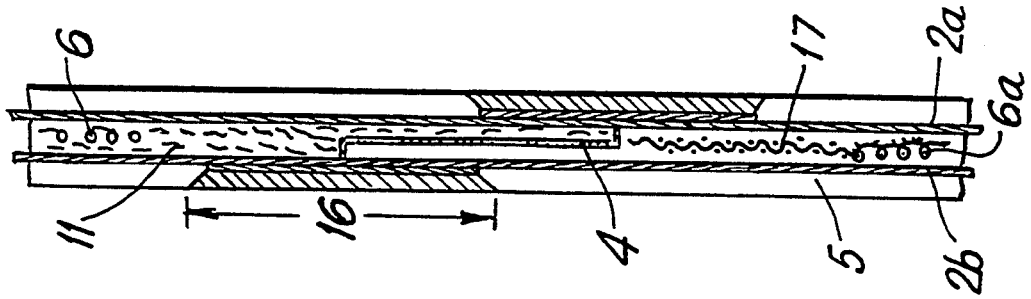
FIG. 4 is a sectional view, on a larger scale, of a closing element with segment sheets connected to each other in rolling direction.

FIG. 4 of the drawing shows a connection point 4 of the long sides of the segments sheets 3, 8 in travel direction of the closing element, similar to the connection point described above, in order to obtain the full width of the hanging portion of the closing element. However, in the connection points in longitudinal direction, the reinforcement layers 2*a* and 2*b* of one segment sheet and reinforcement layers of the next segment sheet must be provided additionally with a flange bridging member 16, since otherwise the reinforcements 2*a* and 2*b* which extend transversely of the rolling direction could not transmit the tensile and upsetting forces over the entire width.

In the illustrated embodiment, the flange bridging members 16 are countersunk in the outer portions 5 of the closing element. However, it is also possible not to countersink the flange bridging members, but to place them on the outer skin of the closing element. The latter embodiment increases the rolling diameter because the thickness of the closing element has increased.

FIG. 4 shows additional tension members 6 which, as already described with respect to FIG. 1, serve to absorb the forces transmitted from the winding drum and simultaneously serve as slit protection against damage due to break-ins. Reference numeral 6*a* denotes an electrically conductive steel or metal strand which is provided for signal or alarm devices and which simultaneously serves as slit protection means.

As additionally illustrated in FIG. 4, the core zone 1 may include additional elements 11. Textile flakes as they are used in V-belts or also steel wool are known as reinforcing elements in order to obtain desired technical effects. This technology makes it possible that, for example, by admixing textile flakes to a soft rubber mixture, the expansion of the finished product is removed without causing hardening of the product and without impairing the alternating load-bearing capacity. The present invention also provides that such additional elements 11 are used. However, for economical reasons, it may already be sufficient to use, for example, harder rubber mixtures of middle-soft plastics materials which meet the requirements of the core zone of the closing element according to the present invention and which have a realistic service life.

Figure 5:
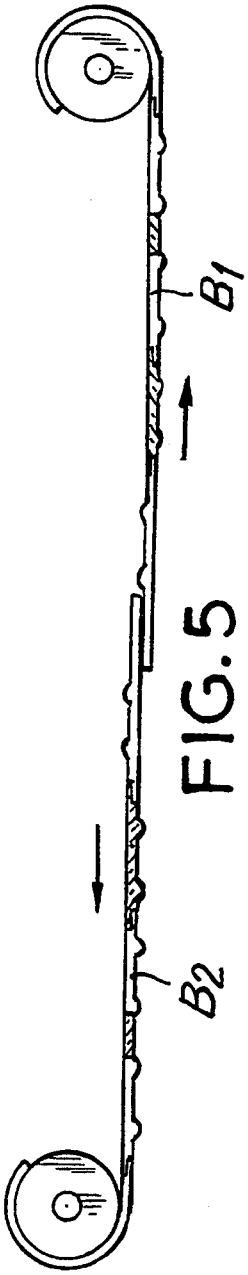
FIG. 5 is top view of two closing elements driven by two rolling devices, wherein the closing elements are constructed as a rolling door which is slidable in horizontal direction.

FIG. 5 of the drawing shows the arrangement of two doors, each having a vertically extending closing element. The two doors can be opened and closed in horizontal direction.

Figure 6:
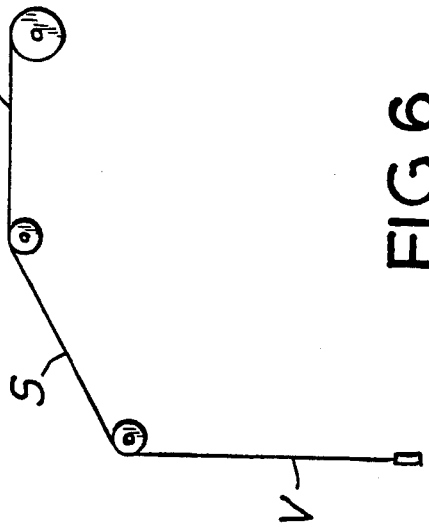
FIG. 6 is a schematic view of a closing element which can be moved in vertical, inclined, and horizontal direction.

Horizontally operating closing elements are possible in accordance with the present invention because the closing elements are capable of transmitting pushing forces of a motor. This solution is used when the available height for the door is small. In this case, the closing element may hang from guide rollers in order to form the upper limitation of the door, or the closing element may be guided in a floor rail to the extent that such an arrangement is possible under the given circumstances. FIG. 6 of the drawing shows a configuration which is possible in accordance with the invention in which the closing elements forms a door, a wall, and a roof. Thus, the overall closing element has a vertical portion, an inclined portion, and a horizontal portion. The vertical portion V serves simultaneously as wall and as door. However, it is also possible to roll up the entire closing element, for example, when polluted or dusty air is to be removed quickly from an industrial plant.

The inclined portion S may be provided, for example, with transparent segment sheets, so that the inclined portion S is permeable to light in the closed state of the closing element and serves as a sliding window replacement. The horizontal portion H serves as a flat roof and, when the closing element is partially rolled up, the transparent segments of the inclined portion may be located at the roof portion. Accordingly, there are unlimited possibilities of combination for stationary buildings, as well as for vehicles of all types.

Figure 7:
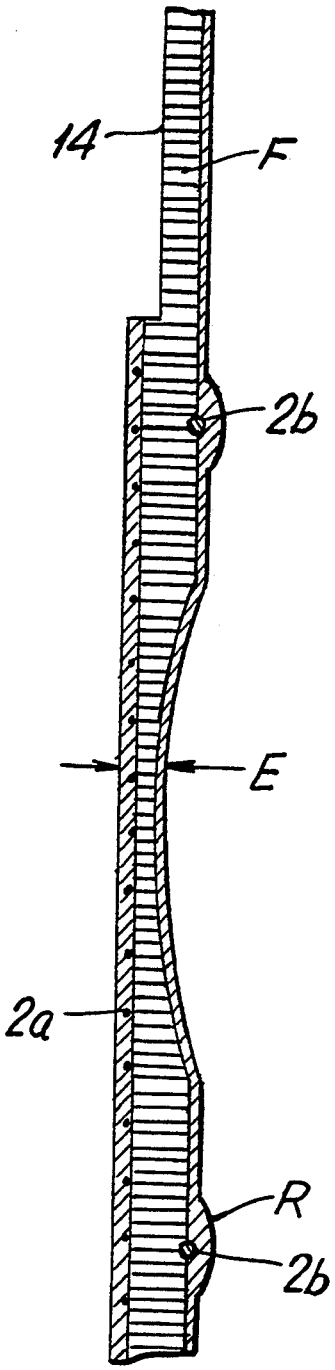
FIG. 7 is a longitudinal sectional view of another embodiment of the closing element of the present invention.

FIG. 7 of the drawing is a longitudinal sectional view of another embodiment of the invention. The core zone 1 has at location E—E a substantially reduced thickness portion. The reinforcement layers on both sides of the core zone have different thicknesses.

In the illustrated embodiment, the transverse reinforcement layer 2*a* on one side of the core zone has reinforcement members which are thin and are spaced apart substantially more closely and the reinforcement members of the reinforcement layer 2*b* are spaced far apart. The reinforcement members of layer 2*a* are bending-resistant steel cord strands and those of layer 2*b* are thick steel ropes.

The partial omission of a reinforcement over portions of the closing element are compensated in the overall static behavior of the closing element. The closing element absorbs loads over the entire surface area. In the example shown in FIG. 7, another adjacent segment sheet 3 may be arranged with an opposite orientation, so that the rib R faces in the other direction, and the continuous transverse reinforcement layer 2*a* with thinner reinforcement members have a static effect over the surface area.

The ribs R are embedded in the material of the outer portion 5 of the closing element which is softer and has a higher resistance to abrasion. FIG. 7 also shows a flange F which is used, for example, for gluing the adjacent segments together at connection point 4.

Figure 8:
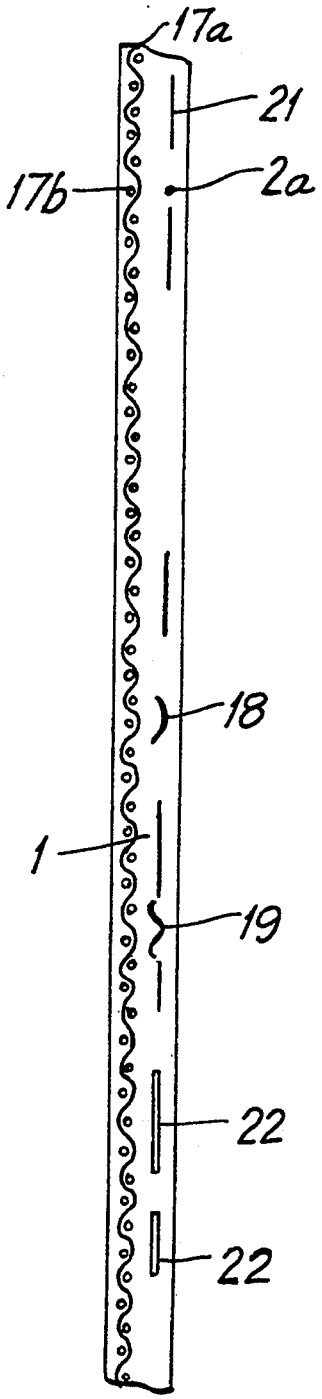
FIG. 8 is a longitudinal sectional view of yet another embodiment of the closing element of the present invention, with different transverse reinforcements and with reinforcements against upsetting forces on only one side.

FIG. 8 of the drawing shows additional possibilities of reinforcing the closing element for stiffening in transverse direction with differently high load-bearing capabilities on the two sides.

A fabric is arranged on one side of the core which faces the inside of the building. The fabric has a relatively thin warp 17*a* and thick weft threads or weft wires 17*b*, wherein the weft is made of materials which are particularly low in expansion. With the wind load being assumed to act on the closing member unilaterally from the outer side of the building, the weft wires 17*b* only absorb tensile forces and, in this case, do not require bending-resistant transverse elements.

On the other side of the closing element are shown a variety of different stiffening elements which absorb extremely high forces when a surface pressure is applied due to wind from the outside. This is because the individual stiffening elements are thicker. Thus, spring steel strips 21 are embedded in the material, alternating with steel cord strands or spring steel 2*a*. Shaped spring steel strips 18, 19 are embedded spaced from smooth spring steel strips 21. In addition, plastic strips, 22 of different widths are provided. These plastic strips are thicker than the spring steel strips 18, 19 since plastic strips must have a greater thickness than steel strips when the force absorbing efficiency is to be the same.

It should be understood that the preferred embodiments and examples described are for illustrative purposes only and are not to be construed as limiting the scope of the present invention which is properly delineated only in the appended claims.

I claim:

1. A closing element for rooms, the closing element extending over a surface area and capable of being rolled up in a rolling direction, the closing element comprising a core zone and outer portions on both sides of the core zone, bending resistant reinforcement layers for increasing transverse stiffness being embedded within the closing element on both sides of the core zone, the reinforcement layers including individual members extending transversely of the rolling direction, wherein at least the core zone is of a flexible material of middle-soft formulation of approximately 70–85 shore A having a high resistance against shear stress and elongation so as to be resistant to shifting of the reinforcement members.

2. The closing element according to claim 1, wherein the outer portions of the closing element are of a soft, abrasion-resistant and noise-damping material.

3. The closing element according to claim 1, wherein the closing element comprises a plurality of segmental sheets which are joined together transversely of the rolling direction, wherein each segmental sheet has flanges at longitudinal sides thereof for connection to adjacent segmental sheets.

4. The closing element according to claim 3, wherein the flanges of adjacent segmental sheets are connected to each other by one of gluing, welding, and vulcanizing.

5. The closing element according to claim 1, wherein the core zone of the closing element is of a different material than the outer portions of the closing element.

6. The closing element according to claim 1, wherein the reinforcement layers on both sides of the core zone are spaced apart from each other by a distance, wherein over predetermined areas of the closing element the distance between the reinforcement layers is increased.

7. The closing element according to claim 1, wherein the closing element has a thickness in a direction transversely of the rolling direction, wherein the thickness is one of increased or reduced in predetermined areas of the closing element which are spaced apart from each other.

8. The closing element according to claim 1, wherein the reinforcement layers comprise reinforcement members, wherein spacing and number of reinforcement members varies in the rolling direction.

9. The closing element according to claim 1, wherein the core zone comprises a thickened portion extending toward one or both outer portions of the closing element.

10. The closing element according to claim 9, comprising additional reinforcement members in the thickened portion of the core zone, wherein in the region of the thickened portion the spacing between reinforcement layers is increased.

11. The closing element according to claim 1, wherein the closing element comprises at least over a predetermined area thereof slit protection inserts which extend one of transversely, obliquely, or diagonally relative to the reinforcement layers.

12. The closing element according to claim 11, wherein the slit protection inserts are electrically conductive .

13. The closing element according to claim 1, wherein the closing element is at least partially of light-permeable or transparent material.

14. The closing element according to claim 1, wherein the closing element is of a flame-retardant or self-extinguishing material.

15. The closing element according to claim 1, the closing element comprising edge portions extending parallel to the rolling direction, the edge portions being provided with a slidable, wear-resistant layer.

16. The closing element according to claim 15, comprising sliding pieces mounted on the edge portions.

17. The closing element according to claim 1, wherein the closing element comprises a plurality of segmental sheets which are joined together longitudinally of the rolling direction, wherein each segmental sheet has flanges at longitudinal sides thereof for connection to adjacent segmental sheets.

18. The closing element according to claim 1, comprising additional stiffening members mounted on predetermined areas of the closing element.

19. The closing element according to claim 1, comprising bending-resistant inserts in one of the outer portions, at least in predetermined areas of the closing element.

20. The closing element according to claim 1, comprising segmental sheets extending transversely of the rolling direction, the segmental sheets having unilaterally thickened core zones, the unilaterally thickened core zones of at least some of the adjacent segmental sheets being directed alternatingly in opposite directions.

21. The closing element according to claim 1, wherein the closing element has one of a horizontal and inclined closing direction.

22. The closing element according to claim 1, further comprising one of textile and metal flakes or fibers mixed into the material of the core zone.

23. The closing element according to claim 15, comprising clamping pieces mounted on the edge portions.

* * * * *